United States Patent [19]

Hartai

[11] 4,392,088

[45] Jul. 5, 1983

[54] DEVICE FOR CHARGING A CHARGING CAPACITOR

[76] Inventor: Julius Hartai, Betzy Kjelsbergsvei 232c, 3000 Drammen, Norway

[21] Appl. No.: 224,020

[22] Filed: Jan. 12, 1981

[30] Foreign Application Priority Data

Jan. 11, 1980 [NO] Norway ..... 800064

[51] Int. Cl.[3] ..... H05B 41/34

[52] U.S. Cl. ..... 315/241 R; 315/200 A; 315/225; 320/1; 340/331

[58] Field of Search ..... 315/200 A, 241 R, 241 S, 315/225; 320/1; 340/29, 77, 81 R, 331

[56] References Cited

U.S. PATENT DOCUMENTS

| | | | |
|---|---|---|---|
| 3,526,821 | 9/1970 | Thomas | 315/241 R X |
| 3,780,344 | 12/1973 | Paget | 320/1 X |
| 3,792,309 | 2/1974 | McDonald | 315/241 S X |
| 4,142,179 | 2/1979 | Lowndes | 340/81 R X |

FOREIGN PATENT DOCUMENTS

| | | | |
|---|---|---|---|
| 2621443 | 12/1977 | Fed. Rep. of Germany | 315/241 R |

*Primary Examiner*—Eugene La Roche
*Attorney, Agent, or Firm*—Young & Thompson

[57] ABSTRACT

A device for charging a charging capacity from an a.c. source via a transformer and rectifier by using at least one auxiliary capacitor for buffer-charging of the charging capacitor is disclosed. The charge of the capacitor is used for example for charging an accumulator and flashing a light source. Change of the capacity of the auxiliary capacitor makes it possible to regulate the charging characteristic of the charging capacitor in charging an accumulator and to regulate the flash character, i.e. intensity and flash frequency, in case of the charging capacitor being discharged through a flash bulb via a thyristor.

5 Claims, 1 Drawing Figure

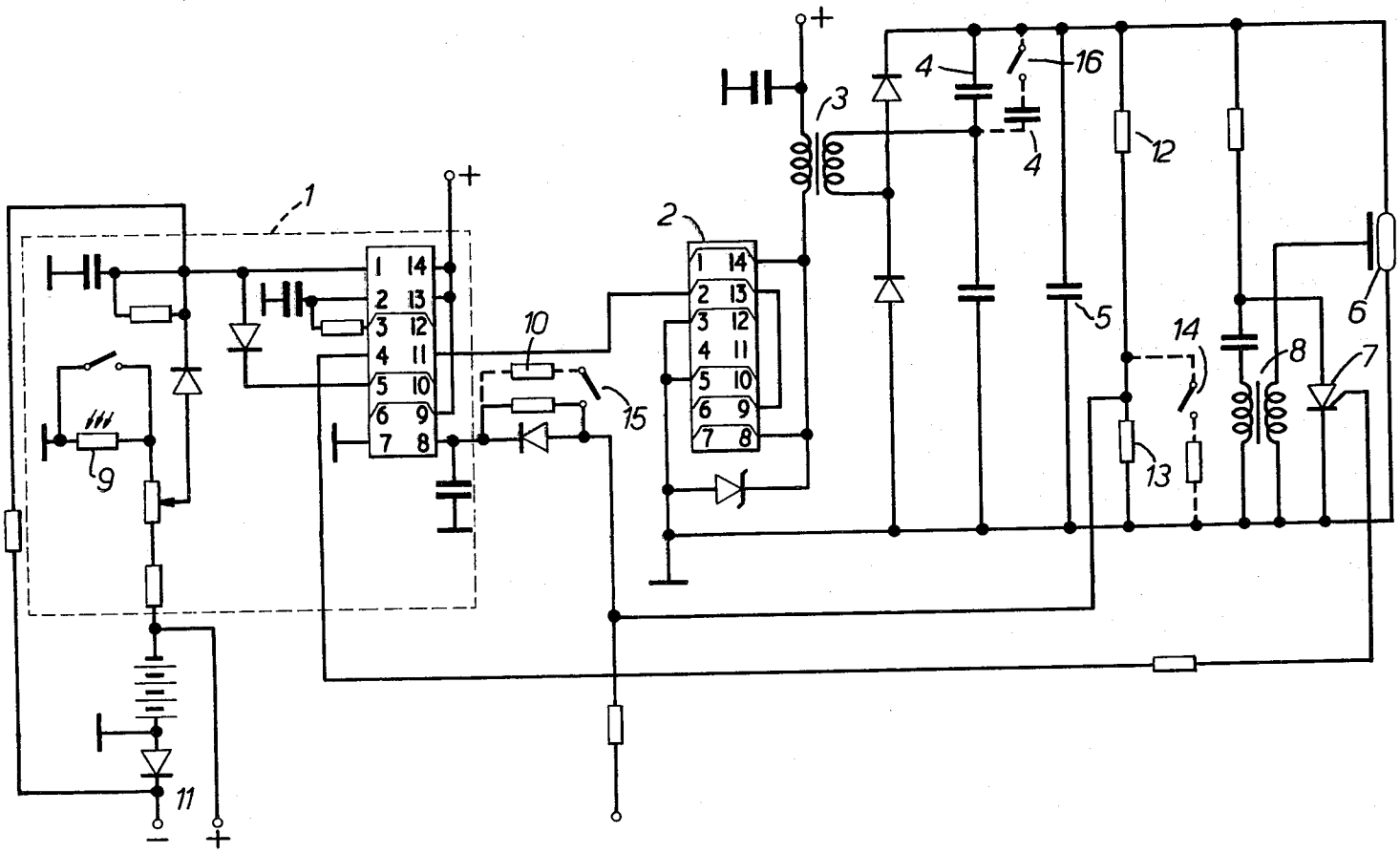
1
2
3
4
5
6
7
8
9
10
11
12
13
14
15
16

DEVICE FOR CHARGING A CHARGING CAPACITOR

BACKGROUND OF THE INVENTION

The invention relates to a device for charging a charging capacitor, comprising a transformer fed by an a.c. source, and a rectifier.

By known devices of this art the a.c. source and the transformer must deliver the full charging energy in one step after each discharge of the charging capacitor. This is especially disadvantageous when the a.c. source is an oscillator fed from a low voltage d.c. source, and the energy of the charged charging capacitor is used to operate a flash bulb. When the device is used for charging an accumulator for complicated regulating means it is necessary to regulate the charging current for the accumulator.

SUMMARY OF THE INVENTION

The object of the invention is to provide a device of the introductorily mentioned art, whereby energy loss in the transformer is minimized, costly regulating means are avoided, and in the case of operating a flash bulb, also the energy loss in the oscillator is minimized and the flash frequency is adjustable within a comparatively large range.

This is according to the invention obtained in that at least one auxiliary capacitor is provided via which the charging capacitor is buffercharged dependent of the capacity of the auxiliary capacitor.

This buffercharge provides by charging of an accumulator, the possibility of regulation of the charging by change of the capacity, respectively, or the number of the auxiliary capacitor.

Further features and advantages of the invention will be evident from the claims.

BRIEF DESCRIPTION OF THE DRAWING

Below one embodiment of the invention will be explained in reference to the drawing which shows a diagram of the embodiment.

The device according to the embodiment comprises an oscillator 1 including Schmitt triggers for instance of the type 4093, with an input for on and off-switching of the oscillator by means of a daylight switch, which may be a light sensitive resistor, or by means of a magnetically operated switch, and an adjustable potentiometer connected over the terminals of the feed voltage source, input for start and stop of the oscillator 1 for each flash by means of the voltage over the charging capacitor 5, and an output for start-signal to the thyristor 7 for ignition of the light source 6.

The transistor 2 is controlled by the oscillator 1 and drives the primary winding of the transformer 3, the secondary winding of which via diodes and auxiliary capacitor or capacitors 4 charge the charging capacitor 5, which in this way only receives the energy which the auxiliary capacity is capable of. The charging continues until the charging capacitor 5 is charged to the set voltage at which the oscillator 1 and the transistor 2 is stopped and the thyristor receives the signal for ignition of the light source 6.

As the auxiliary capacitor 4 charges the charging capacitor 5 with a determined energy quantum for each charging impulse, the charging of the charging capacity will be dependent of the oscillator frequency and the capacity of the auxiliary capacitor. This means that the flash frequency may be varied within a great range. Further variation of the flash frequency may be obtained by blocking the oscillator 1 by means of a resistor 10 a desired time after the discharge. These regulation possibilities involve that the interval between the flashes may be varied in such a way that a programmed pattern, so-called flash characteristic easily may be obtained.

As the auxiliary capacitor or capacitors 4 are the limiting factor for the energy quantum the charging capacitor 5 receives in each charge impulse, the transistor 2 may be dimensioned for substantial lower power than by the known devices and the transformer 3 can be given corresponding small dimensions by closed core and thereby have minimal loss.

In parallel to the charging capacitor 5 is the light source 6 arranged and a series connection containing a capacitor and the primary winding of a second transformer 8, the secondary winding of which when the thyristor 7 is ignited, delivers a high ionizing voltage to the ionizing electrode in the glow lamp, flash bulb 6 etc.

Further the charging capacitor is connected to parallel with a voltage divider 12, 13 which together with the number and capacity of the auxiliary capacitors determine the change of the flash intensity by means 14. This makes identification encoding possible in that the flash characteristic is changed by changing the flash interval and intensity.

Both programming and on-off function may be done by means of magnetically operated switches operated from outside the housing, so that the device is completely water tight and pressure safe.

The lower part of the device beneath the light source serves as fastening haft and container for accumulator or primary batteries, whereby the device easily may be maintained in upright position if it is used as floating marking. The charging input terminals 11 which are used also for automatic start of the oscillator if the flashing device falls into the sea, are placed as to the one terminal externally on the side of the haft and the other terminal is placed in the center of the lower end of the haft. The haft is used for charging of the interval accumulator in that the haft is placed in therefore fitted opening in a charging aggregate which also is used for storing the device.

Having described my invention, I claim:

1. Apparatus for charging a charging capacitor, comprising (a) a.c. power supply means including a d.c. source and an oscillator circuit connected with said d.c. source, said oscillator circuit comprising a multivibrator and having an a.c. output;

(b) first transformer means having a primary winding connected with the output of said oscillator circuit, and a secondary winding;

(c) a rectifier circuit connected in series with said secondary winding;

(d) auxiliary capacitor means connecting said secondary winding in series with the charging capacitor, whereby the charging capacitor is buffer charged in accordance with the capacity of said auxiliary capacitor means;

(e) a light source connected in parallel with the charging capacitor;

(f) a thyristor for controlling the discharge of the charging capacitor to cause said light source to flash, said thyristor being activated under control of said multivibrator; and (g) resistor means for blocking said oscillator for a desired time after discharge of the charging capacitor.

2. Apparatus as defined in claim 1, and further comprising voltage divider means connected in parallel with the charging capacitor and operable with said auxiliary capacitor means for adjusting the intensity of the flashes of said light source.

3. Apparatus as defined in claim 1, wherein said auxiliary capacitor means is adjustable to vary the frequency of the flashes of said light source.

4. Apparatus as defined in claim 1, and further comprising means arranged on the exterior of the device for controlling the frequency and intensity of the flashes of said light source.

5. Apparatus for charging a charging capacitor, comprising (a) a.c. power supply means including a d.c. source and an oscillator circuit connected with said d.c. source, said oscillator circuit comprising a multivibrator and having an a.c. output;

(b) first transformer means having a primary winding connected with the output of said oscillator circuit, and a secondary winding;

(c) a rectifier circuit connected in series with said secondary winding;

(d) auxiliary capacitor means connecting said secondary winding in series with the charging capacitor, whereby the charging capacitor is buffer charged in accordance with the capacity of said auxiliary capacitor means;

(e) a thyristor for controlling the discharge of the charging capacitor, said thyristor being activated under control of said multivibrator; and (f) resistor means for blocking said oscillator for a desired time after discharge of the charging capacitor.

* * * * *